US009829181B2

(12) United States Patent
Min et al.

(10) Patent No.: US 9,829,181 B2
(45) Date of Patent: Nov. 28, 2017

(54) LIGHTING DEVICE

(71) Applicant: LG Innotek Co., Ltd., Seoul (KR)

(72) Inventors: Byeong Guk Min, Seoul (KR); Seung Hyuk Lee, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 191 days.

(21) Appl. No.: 14/908,466

(22) PCT Filed: Jul. 23, 2014

(86) PCT No.: PCT/KR2014/006678
§ 371 (c)(1),
(2) Date: Jan. 28, 2016

(87) PCT Pub. No.: WO2015/016525
PCT Pub. Date: Feb. 5, 2015

(65) Prior Publication Data

US 2016/0169484 A1 Jun. 16, 2016

(30) Foreign Application Priority Data

Jul. 29, 2013 (KR) ..... 10-2013-0089283

(51) Int. Cl.
*F21V 15/015* (2006.01)
*F21V 19/00* (2006.01)
(Continued)

(52) U.S. Cl.
CPC ..... *F21V 15/015* (2013.01); *F21K 9/272* (2016.08); *F21V 19/0035* (2013.01);
(Continued)

(58) Field of Classification Search
CPC .... F21V 15/015; F21V 19/0035; F21V 23/06; F21K 9/272; F21K 9/278
See application file for complete search history.

(56) References Cited

U.S. PATENT DOCUMENTS 7,052,171 B1 * 5/2006 Lefebvre ..... F21V 21/30 362/217.12
9,618,164 B1 * 4/2017 Berry ..... F21V 23/06

FOREIGN PATENT DOCUMENTS

JP 2012-9451 A 1/2012
KR 10-0951873 B1 4/2010
(Continued)

*Primary Examiner* — Anne Hines
(74) *Attorney, Agent, or Firm* — Birch, Stewart, Kolasch & Birch, LLP

(57) ABSTRACT

Disclosed is a lighting device which includes: a cover; a placement portion disposed within the cover; a light source which includes a substrate disposed on the placement portion, a light emitting device disposed on the substrate, and a connector connected to the substrate; a cap which is coupled to both ends of the cover respectively and has at least one opening; a socket including a connection portion which is coupled to the cap and is inserted into the opening of the cap. The connection portion of the socket is inserted into the opening of the cap and is rotated, and then is physically and electrically connected to the connector of the light source. The lighting device according to the embodiment of the present invention can be substituted for a conventional fluorescent lamp. Since the lighting device according to the embodiment of the present invention does not use a wire electrically connecting the socket to the light source, there is no requirement for a soldering process.

20 Claims, 7 Drawing Sheets

(51) Int. Cl.

| | |
|---|---|
| ***F21V 23/06*** | (2006.01) |
| ***H01R 33/94*** | (2006.01) |
| ***F21K 9/272*** | (2016.01) |
| *F21Y 103/10* | (2016.01) |
| *F21Y 115/10* | (2016.01) |

(52) U.S. Cl.
CPC ..... *F21V 23/06* (2013.01); *H01R 33/942* (2013.01); *F21Y 2103/10* (2016.08); *F21Y 2115/10* (2016.08)

(56) References Cited

FOREIGN PATENT DOCUMENTS

| | | | |
|---|---|---|---|
| KR | 10-1225367 | B1 | 1/2013 |
| KR | 10-2013-0055466 | A | 5/2013 |
| WO | WO 2009/148237 | A2 | 12/2009 |

* cited by examiner

[Fig. 1]
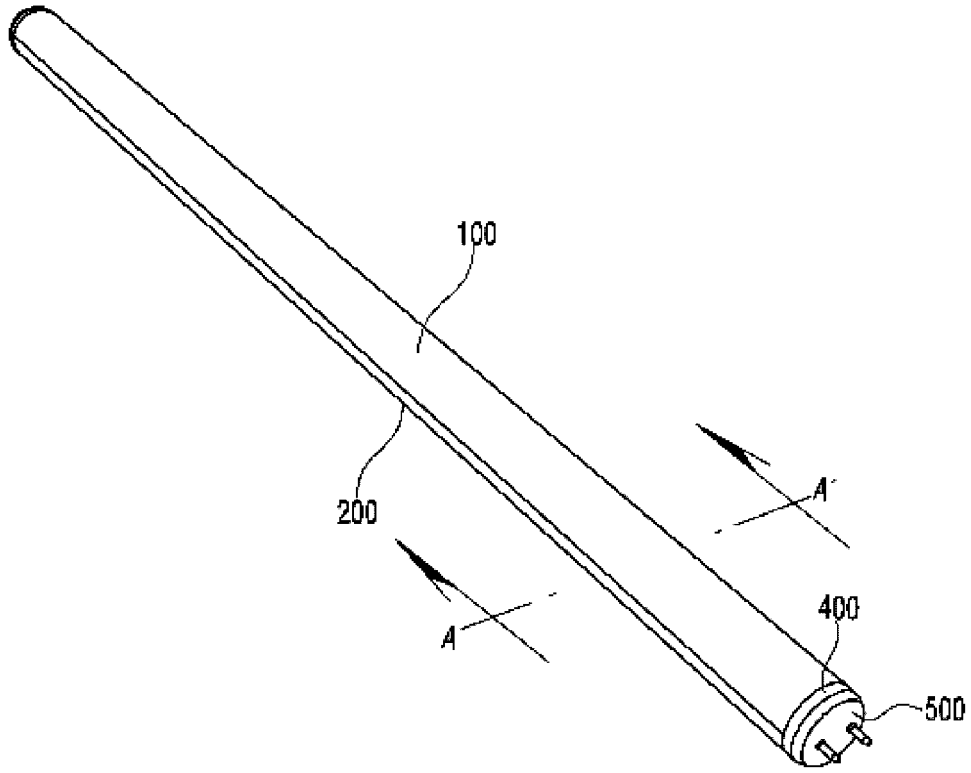
[Fig. 2]
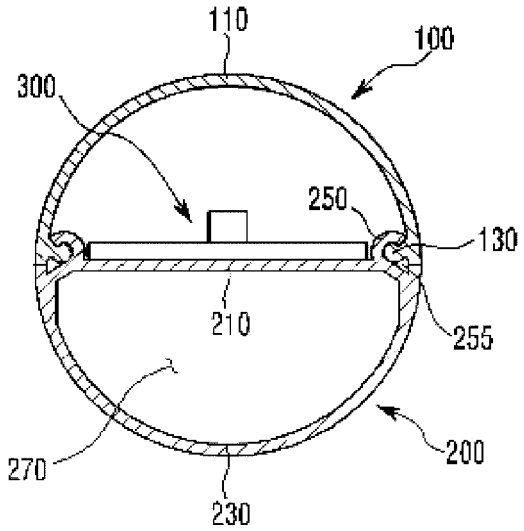

[Fig. 3]
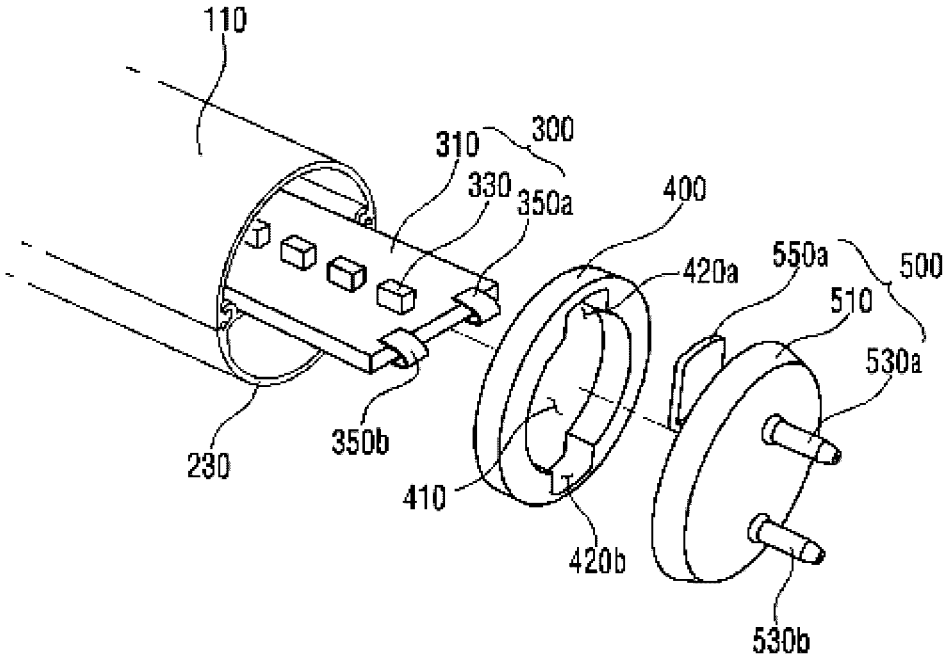

[Fig. 4]
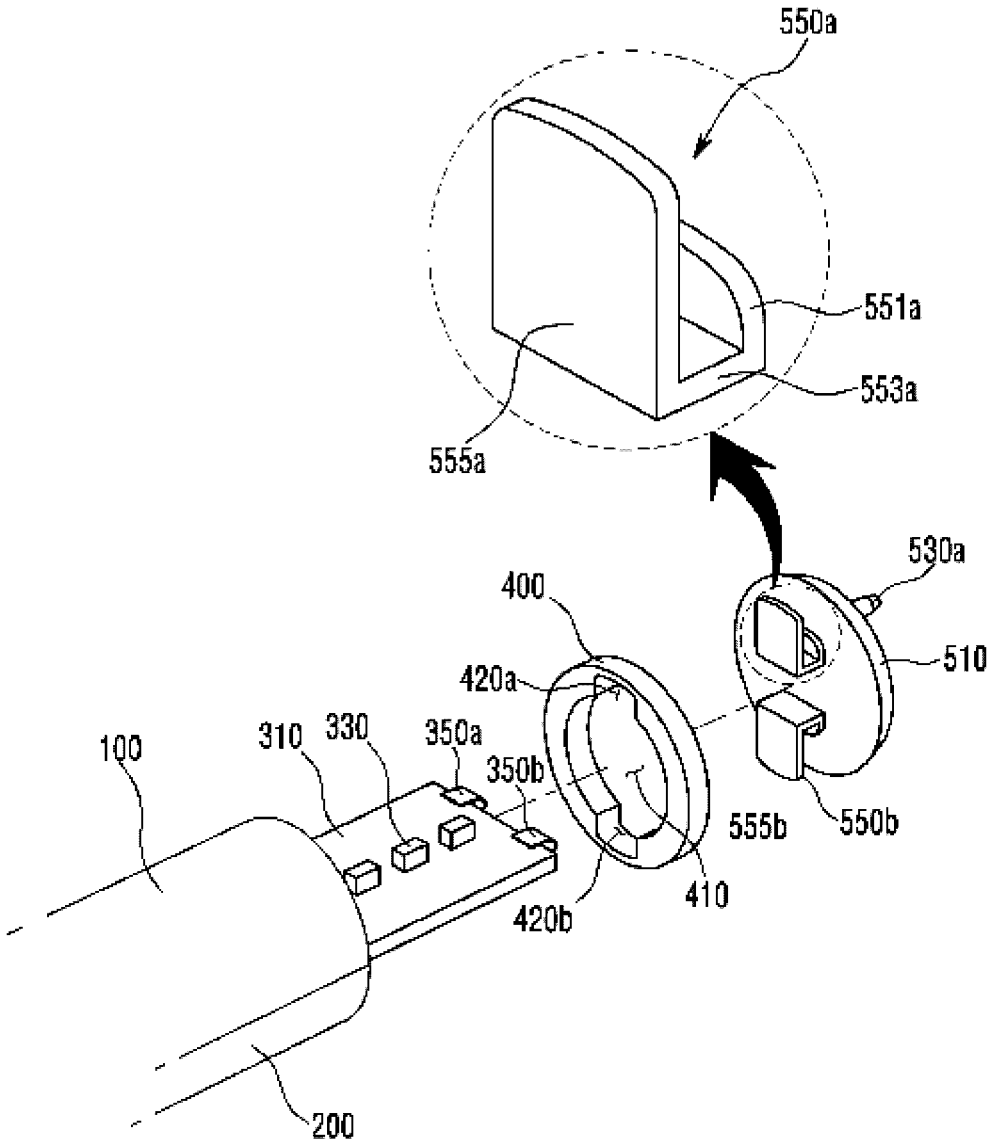

[Fig. 5]
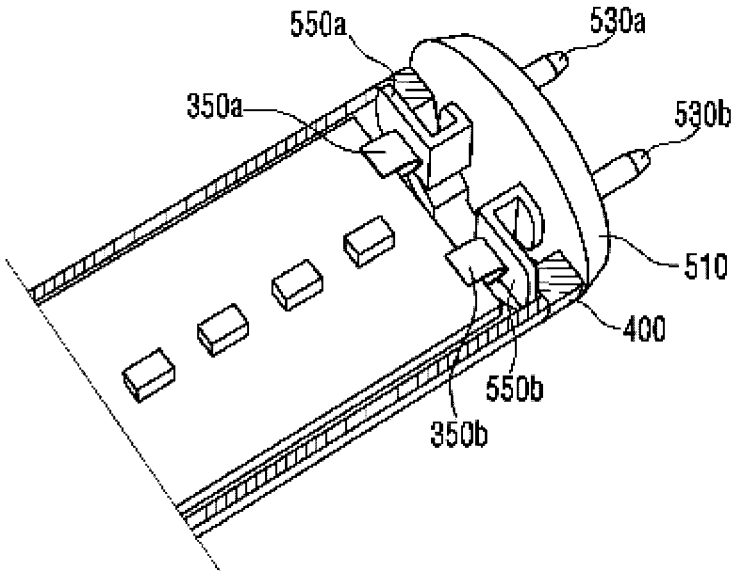

[Fig. 6]
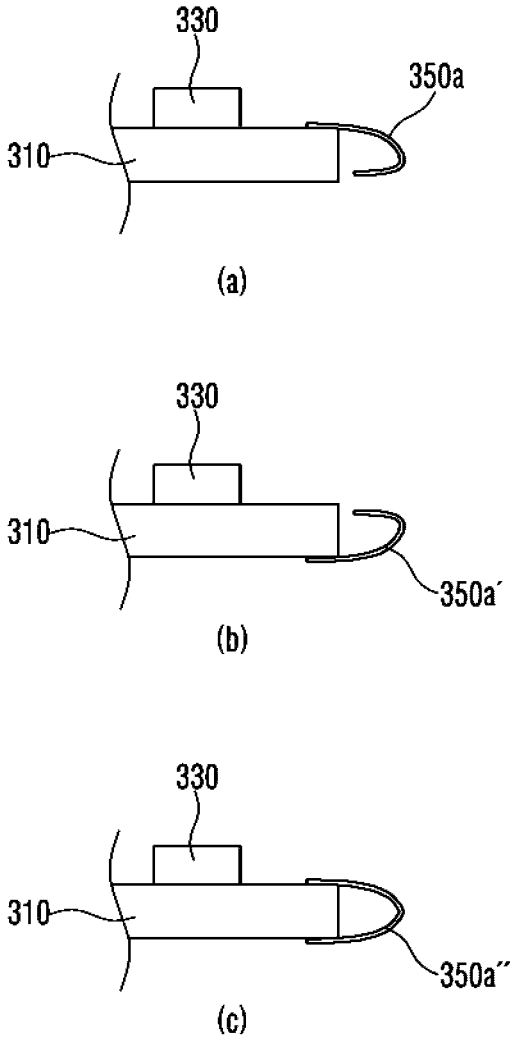

[Fig. 7]
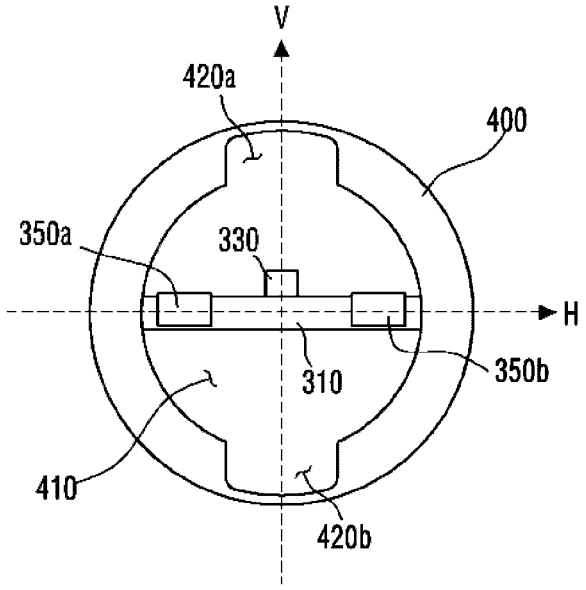
(a)
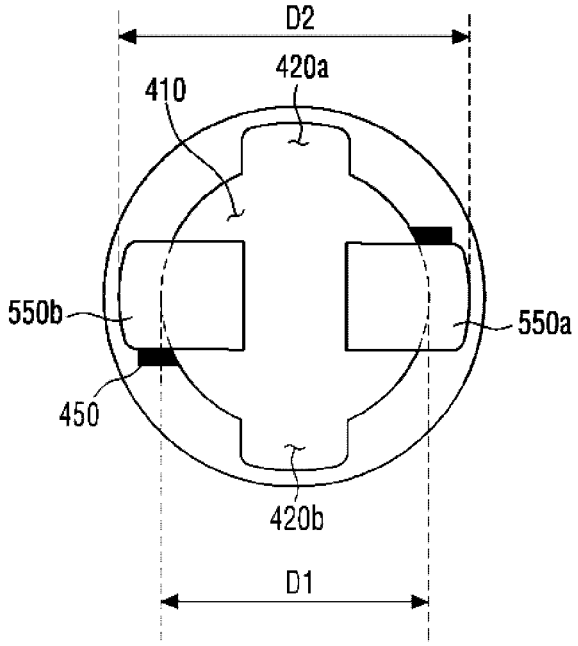
(b)

[Fig. 8]
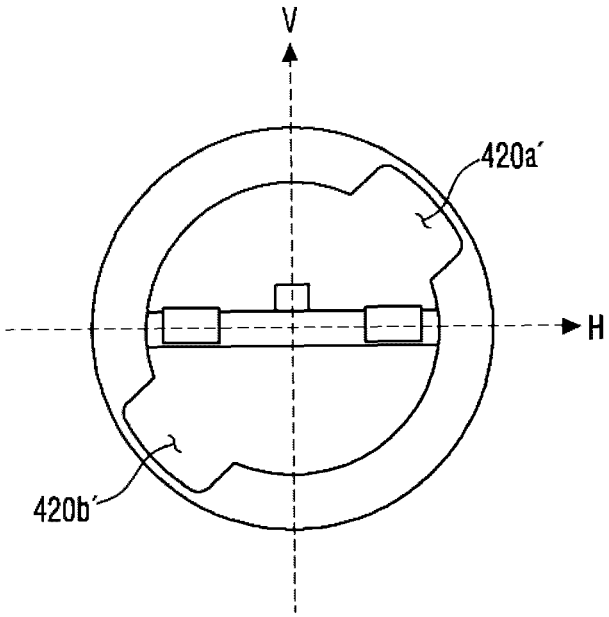
[Fig. 9]
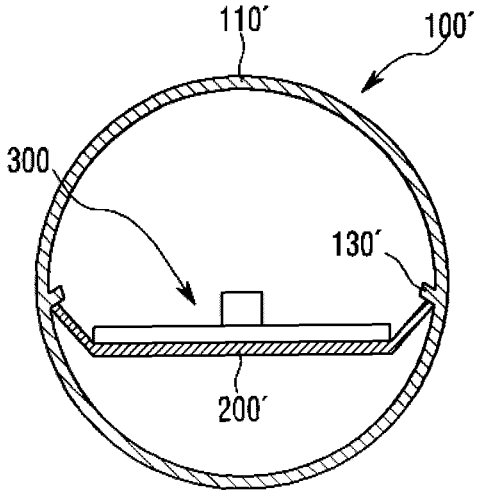

LIGHTING DEVICE

CROSS REFERENCE TO RELATED APPLICATIONS

This application is the National Phase of PCT International Application No. PCT/KR2014/006678, filed on Jul. 23, 2014, which claims priority under 35 U.S.C. 119(a) to Patent Application No. 10-2013-0089283, filed in Republic of Korea on Jul. 29, 2013, all of which are hereby expressly incorporated by reference into the present application.

TECHNICAL FIELD

This embodiment relates to a lighting device.

BACKGROUND ART

A light emitting diode (LED) is a semiconductor element for converting electric energy into light. As compared with existing light sources such as a fluorescent lamp, an incandescent lamp, etc., the LED has advantages of low power consumption, a semi-permanent span of life, a rapid response speed, safety and an environment-friendliness. Therefore, many researches are devoted to substitution of the existing conventional light sources with the LED. The LED is now being increasingly used as a light source for lighting devices, for example, various lamps used interiorly and exteriorly, a liquid crystal display device, an electric sign and a street lamp and the like.

Since the fluorescent lamp which is widely used as an indoor lighting device has a limited lifespan, carbonization occurs with the lapse of a certain time, so that the illuminance of the fluorescent lamp is reduced. Then, the lifespan of the fluorescent lamp is rapidly exhausted and the fluorescent lamp should be changed periodically. Therefore, a lot of consequent cost for maintaining and repairing the fluorescent lamp is required and the fluorescent lamp has a high power consumption.

DISCLOSURE

Technical Problem

This embodiment provides a lighting device which can be substituted for a conventional fluorescent lamp.

Also, this embodiment provides a lighting device which requires no wire.

Also, this embodiment provides a lighting device which requires no rivet.

Technical Solution

One embodiment is a lighting device including: a cover part which has both ends; a light source which includes a substrate disposed within the cover part and a light emitting device disposed on the substrate; a cap which is coupled to both ends of the cover part respectively and has an opening and a concave portion connected with the opening; and a socket which includes a connection portion which is inserted into the opening of the cap and passes through the concave portion of the cap. When the connection portion of the socket passes through the concave portion of the cap and is rotated, the socket is coupled to the cap. The lighting device according to the embodiment of the present invention can be substituted for a conventional fluorescent lamp. Since the lighting device according to the embodiment of the present invention does not use a wire electrically connecting the socket to the light source, there is no requirement for a soldering process.

Another embodiment is a lighting device including: a cover part which has an end and a cap disposed on the end; a light source which includes a substrate disposed within the cover part and a light emitting device disposed on the substrate; and a socket disposed on the cap. The cap of the cover part has an opening and a concave portion connected with the opening. The socket includes a connection portion which is inserted into the opening of the cap and passes through the concave portion of the cap. When the connection portion of the socket passes through the concave portion of the cap and is rotated, the socket is coupled to the cap. The lighting device according to the embodiment of the present invention can be substituted for a conventional fluorescent lamp. Since the lighting device according to the embodiment of the present invention does not use a wire electrically connecting the socket to the light source, there is no requirement for a soldering process.

Advantageous Effects

Through use of the lighting device according to the embodiment of the present invention has an advantage of being substituted for an existing conventional fluorescent lamp.

Also, the lighting device according to the embodiment of the present invention does not use a wire electrically connecting a socket to a light source within the lighting device. Therefore, there is no requirement for a soldering process.

Further, a rivet for coupling a cover part and the socket is not used. Therefore, there is no requirement for a rivet coupling process.

DESCRIPTION OF DRAWINGS

FIG. 1 is a perspective view of a lighting device according to an embodiment of the present invention;

FIG. 2 is a cross sectional view of the lighting device shown in FIG. 1, taken along line A-A';

FIGS. 3 to 4 are exploded perspective views of an end of the lighting device shown in FIG. 1;

FIG. 5 is a view for describing an electrical connection of a light source and a socket shown in FIG. 1;

FIG. 6 is a side view of the lighting device shown in FIGS. 3 to 5;

(a) of FIG. 7 is a front view of a cap shown in FIG. 3, and (b) of FIG. 7 is a rear view of the cap shown in FIG. 3;

FIG. 8 is a view for describing a modified example of a concave portion shown in (a) of FIG. 7; and FIG. 9 is a cross sectional view taken along line A-A' of FIG. 1 and shows a lighting device according to another embodiment of the present invention.

MODE FOR INVENTION

A thickness or size of each layer is magnified, omitted or schematically shown for the purpose of convenience and clearness of description. The size of each component does not necessarily mean its actual size.

In description of embodiments of the present invention, when it is mentioned that an element is formed "on" or "under" another element, it means that the mention includes a case where two elements are formed directly contacting with each other or are formed such that at least one separate element is interposed (indirectly) between the two elements.

The "on" and "under" will be described to include the upward and downward directions based on one element.

Hereafter, a lighting device according to an embodiment of the present invention will be described with reference to the accompanying drawings.

FIG. 1 is a perspective view of a lighting device according to an embodiment of the present invention. FIG. 2 is a cross sectional view of the lighting device shown in FIG. 1, taken along line A-A'. FIGS. 3 to 4 are exploded perspective views of an end of the lighting device shown in FIG. 1. FIG. 5 is a view for describing an electrical connection of a light source and a socket shown in FIG. 1.

Referring to FIGS. 1 to 5, the lighting device according to the embodiment of the present invention may include a first cover part 100, a second cover part 200, a light source 300, a cap 400, and a socket 500. Here, the lighting device according to the embodiment of the present invention is not limited to include all of the first cover part 100, the second cover part 200, the light source 300, the cap 400, and the socket 500. That is, the lighting device according to the embodiment of the present invention may include the omission of at least one of the first cover part 100, the second cover part 200, the light source 300, the cap 400, and the socket 500. Hereafter, each of the components will be described in detail.

The first cover part 100 as well as the second cover part 200 forms the appearance of the lighting device according to the embodiment of the present invention.

The first cover part 100 may be coupled to the second cover part 200. For example, the first cover part 100 and the second cover part 200 may be coupled to each other by inserting a coupling portion 130 of the first cover part 100 into a coupling groove 255 of the second cover part 200 in a sliding manner. Here, the coupling portion 130 may protrude outward from the inner surface of a cover 110 of the first cover part 100.

The mutually coupled first and second cover parts 100 and 200 may have a hollow cylindrical shape which is externally similar to that of an existing conventional fluorescent lamp. Therefore, the lighting device according to the embodiment of the present invention can be substituted for the conventional fluorescent lamp. Here, the mutually coupled first and second cover parts 100 and 200 may form one cover part.

The cover 110 of the first cover part 100 has its outer and inner surfaces. The outer and inner surfaces may have a shape curved to have a predetermined curvature. Specifically, as shown in FIG. 1, the cover 110 may have a semi-cylindrical shape. Also, as shown in FIG. 2, the cross sections of the outer and inner surfaces of the cover 110 may have a hemispherical shape respectively.

The cover 110 is disposed on the light source 300 and may optically change light from the light source 300. For example, the cover 110 may change the wavelength of the light generated by the light source 300. In this case, the cover 110 may include a phosphor. The phosphor may be included within the cover 110. Also, an excitation layer (not shown) containing the phosphor may be disposed on the inner or outer surface of the cover 110. Here, the excitation layer (not shown) may be independently disposed between the cover 110 and the light source 300.

The cover 110 may diffuse the light from the light source 300. Generally, a light emitting diode as one of light emitting devices 330 emits light having strong straightness. The cover 110 diffuses the light from the light emitting diode, thereby removing the hot spot and chrominance due to the light emitting diode. In this case, the cover 110 may include a diffusing agent therewithin, and a diffusing sheet (not shown) having a light diffusion function may be disposed on the inner or outer surface of the cover 110.

The first cover part 100 including the cover 110 and the coupling portion 130 may be made of a resin material such as polycarbonate (PC), silicone, PMMA, etc.

The cover 110 may be transparent or opaque.

The second cover part 200 as well as the first cover part 100 forms the appearance of the lighting device according to the embodiment of the present invention.

The second cover part 200 may include the coupling groove 255 for the coupling to the first cover part 100. The coupling groove 255 is formed by a coupling portion 250. The coupling portion 130 of the first cover part 100 may be inserted into the coupling groove 255 in a sliding manner. The coupling portion 250 of the second cover part 200 may protrude outward from the outer surfaces of an outer portion 230 and/or a placement portion 210.

The light source 300 is placed on the second cover part 200. The second cover part 200 may receive heat from the light source 300 and radiate the heat to the outside. Therefore, the second cover part 200 may function as a heat sink. The second cover part 200 has the placement portion 210 on which the light source 300 is placed. The placement portion 210 may have a flat surface. Here, the placement portion 210 of the second cover part 200 may have not only the flat surface but a surface having a predetermined upward or downward curvature.

The second cover part 200 may include the outer portion 230 forming the appearance of the lighting device according to the embodiment of the present invention. The heat from the light source 300 can be radiated to the outside through the outer portion 230. The outer portion 230 may have a convex outer surface such that the appearance of the lighting device according to the embodiment of the present invention is the same as that of the existing conventional fluorescent lamp. However, the outer surface of the outer portion 230 is not limited to this. The outer portion 230 may have a flat outer surface. The outer portion 230 may have a semi-cylindrical shape. Here, the semi-cylindrical shape means that it has its hemispheric cross section.

At least one heat radiating fin (not shown) may be disposed on the outer portion 230. The heat radiating fin (not shown) increases the heat radiating area of the second cover part 200, thereby improving the heat radiation efficiency of the lighting device.

The second cover part 200 may have a receiver 270 for receiving a driving part (not shown) therewithin. The receiver 270 may be a recess which is formed deep in a direction from one of both sides of the second cover part 200 to the other or which passes through the both sides of the second cover part 200.

The second cover part 200 may be made of a metallic material in order to radiate the heat from the light source 300 to the outside. For example, the second cover part 200 may be made of aluminum, aluminum alloy, magnesium, magnesium alloy, copper, copper alloy, and the like.

The light source 300 is placed on the second cover part 200. Specifically, a substrate 310 of the light source 300 may be placed on the placement portion 210 of the second cover part 200.

The light source 300 may include the substrate 310, the light emitting device 330, and connector 350*a* and 350*b*.

The substrate 310 is formed by printing a circuit pattern on an insulator. For instance, the substrate 310 may include a common printed circuit board (PCB), a metal core PCB, a flexible PCB, a ceramic PCB or the like. Here, the insulator may be an insulating sheet which is thinner than a common substrate.

The surface of the substrate 310 may be coated with a material capable of efficiently reflecting light or may be coated with a color capable of efficiently reflecting light, for example, white, silver and the like.

The substrate 310 may have a predetermined length in a longitudinal direction of the lighting device according to the embodiment of the present invention. It is probable that one substrate 310 is provided or a plurality of the substrates 310 are connected to each other.

A plurality of the light emitting device 330 may be disposed on one side of the substrate 310. The light emitting device 330 may be a light emitting diode chip emitting red, green and blue light or a light emitting diode chip emitting ultraviolet light. Here, the light emitting diode chip may have a lateral type or vertical type and may emit blue, red, yellow or green light.

A lens (not shown) may be disposed on the light emitting device 330. The lens (not shown) is disposed to cover the light emitting device 330. The lens (not shown) is able to adjust the orientation angle or direction of the light emitted from the light emitting device 330. The lens (not shown) has a hemispherical shape and may be formed of a light-transmitting resin such as a silicone resin or an epoxy resin. The light-transmitting resin may include a wholly or partially distributed phosphor. The lens (not shown) may have a poly-pyramidal or polygonal pillar shape as well as the hemispherical shape. The lens (not shown) can be implemented in a recessed form, that is, in a form in which a certain portion of the lens is recessed.

When the light emitting device 330 is a blue light emitting diode, the phosphor included in the light-transmitting resin of the lens (not shown) may include at least one of garnet based phosphor (YAG, TAG), silicate based phosphor, nitride based phosphor and oxynitride based phosphor.

It is possible to create natural sunlight (white light) by including yellow phosphor alone to the light-transmitting resin. Additionally, green phosphor or red phosphor may be further included in order to improve a color rendering index and to reduce a color temperature.

The garnet phosphor (YAG), the silicate phosphor and the oxynitride phosphor may be used as the yellow phosphor. The silicate phosphor and the oxynitride phosphor may be used as the green phosphor. The nitride phosphor may be used as the red phosphor. However, there is no limitation to this. The light-transmitting resin may be mixed with various kinds of the phosphors or may be configured by a layer including the red phosphor, a layer including the green phosphor and a layer including the yellow phosphor, which are formed separately from each other.

The connector 350*a* and 350*b* may be directly electrically connected to the socket 500. Specifically, the connector 350*a* and 350*b* is physically or mechanically connected to connection portion 550*a* and 550*b* of the socket 500, and thus, can be electrically connected without a separate wire.

The connector 350*a* and 350*b* is electrically connected to the circuit pattern of the substrate 310. The connector 350*a* and 350*b* may be disposed on one side end of the substrate 310.

The connector 350*a* and 350*b* may include a first connector 350*a* and a second connector 350*b*. The first and second connectors 350*a* and 350*b* may be disposed apart from each other at one side edge of the substrate 310. Portions of the first and second connectors 350*a* and 350*b* may be disposed to protrude outward from the substrate 310.

The first and second connectors 350*a* and 350*b* may be made of a metallic material for electrical connection. For example, the metallic material may include aluminum, copper, etc.

The connector 350*a* and 350*b* may have a predetermined elasticity and a predetermined shape so as to be physically or mechanically connected to the connection portion 550*a* and 550*b* of the socket 500. Specifically, one end of the connector 350*a* and 350*b* having a predetermined elasticity may have a hook shape connected to the substrate 310. Here, the hook shape may mean a shape having a portion of a circular shape, an elliptical shape, and a parabolic shape between the one end and the other end of the connector, or may mean a shape having a portion bent at least once between the one end and the other end of the connector.

In more detail, the connector 350*a* and 350*b* will be described referring to FIG. 6.

FIG. 6 is a side view of the lighting device shown in FIGS. 3 to 5.

Referring to (a) of FIG. 6, one end of the connector 350*a* may be disposed on the top surface of the substrate 310 and the other end may be disposed apart from the side of the substrate 310 by a predetermined distance. A central portion between the one end and the other end of the connector may be a plate having a predetermined curvature. Here, the central portion may be comprised of a plurality of plates having at least two mutually different curvatures.

Referring to (b) of FIG. 6, one end of the connector 350*a*' may be disposed on the bottom surface of the substrate 310 and the other end may be disposed apart from the side of the substrate 310 by a predetermined distance. A central portion between the one end and the other end of the connector may be a plate having a predetermined curvature. Here, the central portion may be comprised of a plurality of plates having at least two mutually different curvatures.

Referring to (c) of FIG. 6, both ends of the connector 350" may be disposed on the substrate 310. Specifically, one end of the connector may be disposed on the top surface of the substrate 310 and the other may be disposed on the bottom surface of the substrate 310. A central portion between the one end and the other end of the connector may be a plate having a predetermined curvature. Here, the central portion may be comprised of a plurality of plates having at least two mutually different curvatures.

Here, the first connector 350*a* among the two connectors 350*a* and 350*b* shown in FIGS. 3 to 5 may be the connector shown in (a) of FIG. 6, and the second connector 350*b* may be the connector shown in (b) of FIG. 6. Further, all the two first and second connectors 350*a* and 350*b* may be the connector shown in (c) of FIG. 6. The connector 350*a* and 350*b* may have a long shape in one direction as well as the hook shape. The shape of the connector 350*a* and 350*b* is not limited to the foregoing.

Referring back to FIGS. 1 to 5, the cap 400 may be coupled respectively to both ends of the mutually coupled first and second cover parts 100 and 200. For example, the cap 400 may be coupled to both ends of the first cover part 100 and the second cover part 200 by means of a separate fixing member (not shown) or an adhesive.

Also, the cap 400 may have a structure covering both ends of the first cover part 100 and the second cover part 200, that is to say, a structure in which one ends of the mutually coupled first and second cover parts 100 and 200 are inserted into the cap 400.

This cap 400 is inserted respectively into both ends of the mutually coupled first and second cover parts 100 and 200, thereby more enhancing the coupling of the first cover part 100 and the second cover part 200, and thereby preventing the first cover part 100 inserted into the second cover part 200 in a sliding manner from being separated.

Meanwhile, the cap 400 may be formed integrally with the cover parts 100 and 200. Therefore, the cap 400 may be one component of the cover parts 100 and 200.

The cap 400 may have a ring shape with a central opening 410. This will be described in detail with reference to FIG. 7.

Part (a) of FIG. 7 is a front view of the cap shown in FIG. 3, and part (b) of FIG. 7 is a rear view of the cap shown in FIG. 3.

Referring to FIGS. 3 to 5 and 7, the opening 410 is formed in the central portion of the cap 400. The opening 410 may be formed to pass through the outer surface and inner surface of the cap 400.

The diameter D1 of the opening 410 is less than a distance D2 between the end of the first connection portion 550*a* of the socket 500 and the end of the second connection portion 550*b*. This intends that when the end of the first connection portion 550*a* of the socket 500 and the end of the second connection portion 550*b* of the socket 500 are inserted into concave portions 420*a* and 420*b* of the cap 400 respectively and rotated, the first and second connection portions 550*a* and 550*b* are separated through the opening 410.

The concave portions 420*a* and 420*b* are recesses formed in the inner surface of the cap 400, which defines the opening 410. The concave portions 420*a* and 420*b* may have a predetermined depth in a direction from the inner surface to the outer surface of the cap 400.

As shown in the drawings, the two or more concave portions 420*a* and 420*b* may be provided. However, the number of the concave portions is not limited to this. One concave portion may be also provided.

The first concave portion 420*a* and the second concave portion 420*b* may be disposed opposite to each other.

The first concave portion 420*a* and the second concave portion 420*b* may be disposed on a predetermined position of the inner surface of the cap 400. Specifically, the first concave portion 420*a* and the second concave portion 420*b* may be disposed on a vertical axis "V". The vertical axis "V" means an axis which is perpendicular to the substrate 310 or is perpendicular to a horizontal axis "H" parallel to the top or bottom surface of the substrate 310.

Here, the first concave portion 420*a* and the second concave portion 420*b* are not limited to be disposed on the vertical axis "V". For example, the first concave portion 420*a* and the second concave portion 420*b* may be disposed between the horizontal axis "H" and the vertical axis "V". This will be described with reference to FIG. 8.

FIG. 8 is a view for describing a modified example of the concave portion shown in (a) of FIG. 7.

Referring to FIG. 8, the first concave portion 420*a*' and the second concave portion 420*b*' may be disposed between the horizontal axis "H" and the vertical axis "V". When the first concave portion 420*a*' and the second concave portion 420*b*' may be disposed between the horizontal axis "H" and the vertical axis "V", the rotation angle of the socket 500 can be reduced more than that shown in (a) of FIG. 7. Therefore, the speed of the assembly process thereof can be improved.

The shapes of the concave portions 420*a* and 420*b* may correspond to the ends of the connection portions 550*a* and 550*b*. Otherwise, the concave portions 420*a* and 420*b* may have a shape into which the ends of the connection portions 550*a* and 550*b* can be sufficiently inserted.

After the connection portions 550*a* and 550*b* of the socket 500 are inserted into the opening 410 and the concave portions 420*a* and 420*b*, the connection portions 550*a* and 550*b* of the socket 500 are rotated by an external force. As a result, the cap 400 and the socket 500 can be coupled to each other.

Here, the cap 400 may further include a catching protrusion 450. The catching protrusion 450 may be, as shown in (b) of FIG. 7, disposed on the inner surface of the cap 400. Specifically, the catching protrusion 450 may be formed to protrude upward from the inner surface of the cap 400.

The catching protrusion 450 may restrict the rotation of the connection portion 550*a* and 550*b* of the socket 500. Specifically, the connection portions 550*a* and 550*b* of the socket 500 are inserted into the concave portions 420*a* and 420*b* of the cap 400 and rotated at a predetermined angle, and then are connected to the connectors 350*a* and 350*b* of the substrate 310. As a result, the connection portions 550*a* and 550*b* of the socket 500 can be fixed not to be rotated any more.

The socket 500 is coupled to the cap 400 coupled to both ends of the first cover part 100 and the second cover part 200. Also, the socket 500 may be electrically and mechanically connected to the connectors 350*a* and 350*b* of the light source 300 while being connected to the cap 400.

Specifically, when the socket 500 is primarily coupled to the cap 40 and then is rotated clockwise or counterclockwise at a predetermined angle by an external force, the socket 500 can be not only strongly coupled to the cap 400 but also physically and electrically connected to the connectors 350*a* and 350*b*.

The socket 500 may include a body 510, a pin 530*a* and 530*b*, and the connection portion 550*a* and 550*b*.

The body 510 is disposed on the cap 400. The body 510 may have a shape corresponding to the ring-shaped cap 400. The body 510 blocks the opening 410 and the concave portion 420*a* and 420*b* of the cap 400, thereby preventing foreign substances from permeating into the lighting device according to the embodiment of the present invention.

At least two pins 530*a* and 530*b* may be disposed on the outer surface of the body 510. Specifically, the first pin 530*a* and the second pin 530*b* may be disposed apart from each other on the outer surface of the body 510. The first pin 530*a* and the second pin 530*b* may have the same standard as that of the pin of a conventional fluorescent lamp.

At least two connection portions 550*a* and 550*b* may be disposed on the inner surface of the body 510. Specifically, the first connection portion 550*a* and the second connection portion 550*b* may be disposed apart from each other on the inner surface of the body 510. The first connection portion 550*a* may be electrically connected to the first pin 530*a*, and the second connection portion 550*b* may be electrically connected to the second pin 530*b*. Here, the electrical connection between the first connection portion 550*a* and the first pin 530*a* can be made when any one of the first connection portion 550*a* and the first pin 530*a* passes through the body 510 and is directly electrically connected to the other.

For the electrical connection between the pin 530*a* and 530*b* and the light source 300, the connection portion 550*a* and 550*b* may be made of a conductive material. For example, the connection portion 550*a* and 550*b* may be made of a metallic material.

The first connection portion 550*a* may, as shown in FIG. 4, include a first contacting part 551*a*, an extension part 553*a*, and a second contacting part 555*a*. Since the second connection portion 550*b* is the same as this, the first connection portion 550*a* alone will be described hereafter.

The first contacting part 551*a* is disposed to contact with the inner surface of the body 510 and is electrically connected to the first pin 530*a*. In the formation of the first contacting part 551*a* in the first connection portion 550*a*, since a contact area between the inner surface of the body 510 and the first contacting part 551*a* of the first connection portion 550*a* is greater than a contact area between the inner surface of the body 510 and the extension part 553*a* instead of the first contacting part 551*a* of the first connection portion 550*a*, the first connection portion 550*a* has a relatively stronger fixing force. Therefore, the first connection portion 550*a* can be more stably coupled to the socket 500.

The first contacting part 551*a* may be, as shown in FIG. 5, disposed in the first opening 410 of the cap 400.

The extension part 553*a* may extend outwardly from the first contacting part 551*a*. The extension part 553*a* may extend upward from one side of the first contacting part 551*a*. The extension part 553*a* may be, as shown in FIG. 5, in the first opening 410 of the cap 400.

The second contacting part 555*a* is disposed on the first contacting part 551*a*. One side of the second contacting part 555*a* is connected to the extension part 553*a*. The second contacting part 555*a* may be supported by the extension part 553*a* and disposed on the first contacting part 551*a*.

When the second contacting part 555*a* passes through the first opening 410 and the concave portion 420*a* of the cap 400 and then is rotated by an external force, the end of the second contacting part 555*a* is caught by the inner surface of the cap 400, so that the socket 500 is not separated from the cap 400. Also, when the end of the second contacting part 555*a* is rotated at a predetermined angle while being caught by the inner surface of the cap 400, the second contacting part 555*a* comes in physical contact with and electrically connected to the connector 350*a* of the light source 300.

Here, the end of the second contacting part 555*a* may be spaced apart from the second cover part 200 by a predetermined distance. This intends to prevent an electrical short-circuit when the electrically conductive second contacting part 555*a* comes in contact with the metallic second cover part 200.

The first contacting part 551*a*, the extension part 553*a*, and the second contacting part 555*a* of the first connection portion 550*a* may, as a whole, have a quadrangular cross section of which one side is open or a U-shaped cross section. The extension part 553*a* may be directly disposed on the body 510 without the first contacting part 551*a*. In this case, the extension part 553*a* may be directly electrically connected to the first pin 530*a*.

Hereafter, the physical and electrical connection of the light source 300, the cap 400, and the socket 500 will be described with reference to FIGS. 3 to 5 in accordance with a time sequence.

First, referring to FIGS. 3 and 4, the light source 300 is disposed on the second cover part 200, and the first cover part 100 is coupled to the second cover part 200. Then, the cap 400 is coupled to both ends of the mutually coupled the first cover part 100 and the second cover part 200 respectively.

After the cap 400 is coupled to both ends of the mutually coupled the first cover part 100 and the second cover part 200 respectively, the socket 500 is coupled to the cap 400. Specifically, the connection portion 550*a* and 550*b* of the socket 500 is inserted into the opening 410 and the concave portion 420*a* and 420*b* of the cap 400. Here, the end of the second contacting part 555*a* of the connection portion 550*a* and 550*b* is inserted into the concave portion 420*a* and 420*b*. Here, when the first and second connection portions 550*a* and 550*b* are inserted into the first opening 410 and the concave portions 420*a* and 420*b*, the second contacting part 555*a* of the first and second connection portion 550*a* and 550*b* is disposed to pass through the opening 410 and the concave portions 420*a* and 420*b*.

The socket 500 coupled to the cap 400 is rotated clockwise or counterclockwise. During the rotation of the socket 500, the end of the second contacting part 555*a* moves along the inner surface of the cap 400.

When the socket 500 is rotated at a predetermined angle, the first and second connection portions 550*a* and 550*b* are, as shown in FIG. 5, electrically and mechanically connected to the first and second connectors 350*a* and 350*b* of the light source 300. This process will be described in detail. When the socket 500 is rotated, for example, at a predetermined angle, the second contacting part 555*a* of the first connection portion 550*a* contacts with the end of the first connector 350*a*, and when the socket 500 is further rotated, the second contacting part 555*a* moves pushing the end of the first connector 350*a*. Then, the first connector 350*a* with a predetermined elasticity maintains the tighter contact with the second contacting part 555*a*. When the socket 500 is approximately rotated at 90 degrees, the end of the first connector 350*a* comes in contact with the second contacting part 555*a*, and the connector 350*a* continues to push the second contacting part 555*a* by the elasticity thereof. Therefore, the end of the second contacting part 555*a* is fixed close to the inner surface of the cap 400. That is, due to the rotation of the socket 500, the socket 500 is not only securely fixed to the cap 400 but at the same time also is physically and electrically connected to the light source 300.

As such, the lighting device shown in FIGS. 1 to 5 according to the embodiment of the present invention includes the connector 350*a* and 350*b* of the light source 300, the cap 400, and the connection portion 550*a* and 550*b* of the socket 500, it does not require a conventionally used wire for electrical connection between the substrate 310 of the light source 300 and the pin 530*a* and 530*b* of the socket 500. Therefore, the lighting device has a simple internal structure and does not need a soldering process for wire connection.

Besides, since the socket 500 is connected to the cap 400 and then is rotated and securely coupled to the cap 400, there is no necessity of a rivet like a bolt, which is used to couple the socket 500 to the cap 400. Therefore, a rivet coupling process is not required.

Meanwhile, FIG. 9 is a cross sectional view taken along line A-A' of FIG. 1 and shows a lighting device according to another embodiment of the present invention.

The lighting device shown in FIG. 9 includes the light source 300, the cap 400, and the socket 500, which are shown in FIGS. 2 to 5. A cover part 100' and a placement portion 200' of the lighting device shown in FIG. 9 are different from those of the lighting device shown in FIGS. 2 to 5.

Hereafter, this will be described in detail.

Unlike the first cover part 100 shown in FIG. 2, the cover part 100' shown in FIG. 9 has a one cylindrical shape. Specifically, the cover part 100' shown in FIG. 9 has a cylindrical shape similar to a coupled body of the first cover part 100 and the second cover part 200 shown in FIG. 2.

The cover part 100' may include a cover 110' and a coupling portion 130'.

The cover 110' has a cylindrical shape having its outer and inner surfaces and has a predetermined length. The coupling portion 130' may protrude from the inner surface of the cover 110'.

The placement portion 200' may be disposed to be inserted into the cover 110' in a sliding manner. Both ends of the placement portion 200' may be caught by the coupling portion 130' and fixed within the cover 110'.

The light source 300 is disposed on the placement portion 200'. The placement portion 200' may be made of a material capable of easily receiving the heat emitted from the light source 300 and radiating. For example, the placement portion 200' may be made of a metallic material including aluminum, an aluminum alloy, magnesium, a magnesium alloy, and copper, etc.

A driving part (not shown) may be disposed under the placement portion 200'. Specifically, the driving part (not shown) may be disposed in a space between the placement portion 200' and the cover 110'.

Although the embodiments of the present invention were described above, these are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

The invention claimed is:

1. A lighting device comprising:

a cover part which has both ends;

a light source which comprises a substrate disposed within the cover part, a light emitting device disposed on the substrate, and a connector disposed on the substrate;

a cap which is coupled to both ends of the cover part respectively and has an opening and a concave portion connected with the opening; and a socket which comprises a connection portion which is inserted into the opening of the cap and passes through the concave portion of the cap, wherein, when the connection portion of the socket passes through the concave portion of the cap and is rotated, the connection portion of the socket is coupled to the cap and is electrically connected to the connector of the light source.

2. The lighting device of claim 1, wherein the connection portion of the socket comprises a first connection portion and a second connection portion which are disposed apart from each other, wherein the opening of the cap is formed in the central portion of the cap, and wherein the first connection portion and the second connection portion are disposed in the opening, wherein an end of the first connection portion and an end of the second connection portion pass through the concave portion of the cap, wherein a diameter of the opening is less than a distance between the end of the first connection portion and the end of the second connection portion, and wherein, when the socket is rotated, the end of the first connection portion and the end of the second connection portion move along an inner surface of the cap.

3. The lighting device of claim 1, wherein the concave portion of the cap is disposed on a vertical axis perpendicular to a horizontal axis parallel to a top or bottom surface of the substrate of the light source.

4. The lighting device of claim 1, wherein the concave portion of the cap is disposed between a horizontal axis parallel to a top or bottom surface of the substrate of the light source and a vertical axis perpendicular to the horizontal axis.

5. The lighting device of claim 1, wherein the socket further comprises a pin electrically connected to the connection portion, and wherein the pin further comprises a first pin and a second pin which are disposed apart from each other, and wherein the socket comprises a body comprising an inner surface on which the connection portion is disposed and an outer surface on which the pin is disposed, and wherein the inner surface of the body blocks the opening and the concave portion of the cap.

6. The lighting device of claim 5, wherein the connection portion of the socket comprises:

a first contacting part which is connected to the body and is disposed in the opening of the cap;

an extension part which is connected to the first contacting part and is disposed in the opening of the cap; and a second contacting part which is disposed on the first contacting part, is connected to the extension part, and passes through the opening and the concave portion of the cap.

7. The lighting device of claim 6, wherein the extension part extends in a direction perpendicular to the first contacting part.

8. The lighting device of claim 5, wherein the connection portion of the socket has a quadrangular cross section of which one side is open or a U-shaped cross section.

9. The lighting device of claim 1, wherein the connector of the light source has a predetermined elasticity, wherein the connector of the light source has one end connected to the substrate and the other end protruding outward from the substrate, and wherein, when the connection portion of the socket passes through the concave portion of the cap and is rotated, the other end of the connector is directly connected to the connection portion of the socket.

10. The lighting device of claim 9, wherein the other end of the connector is spaced apart from a side of the substrate by a predetermined distance.

11. The lighting device of claim 9, wherein a central portion between the one end and the other end of the connector is a plate having a predetermined curvature.

12. The lighting device of claim 11, wherein the central portion comprises a plurality of plates having at least two mutually different curvatures.

13. The lighting device of claim 9, wherein the one end of the connector is disposed on a top or bottom surface of the substrate.

14. The lighting device of claim 1, wherein the cover part comprises a first cover part and a second cover part, wherein the first cover part comprises a coupling portion, wherein the second cover part comprises a placement portion on which the substrate is disposed and a coupling groove into which the coupling portion is inserted, and radiates heat from the light source.

15. The lighting device of claim 1, wherein the cover part comprises a catching protrusion, and wherein the cover part further comprises a placement portion which is caught by the catching protrusion of the cover part and fixed and on which the substrate is disposed.

16. The lighting device of claim 1, wherein the cap further comprises a catching protrusion, and wherein the catching protrusion restricts the rotation of the connection portion of the socket.

17. A lighting device comprising:

a cover part which has an end and a cap disposed on the end;

a light source which comprises a substrate disposed within the cover part, a light emitting device disposed on the substrate, and a connector disposed on the substrate; and a socket disposed on the cap, wherein the cap of the cover part has an opening and a concave portion connected with the opening, wherein the socket comprises a connection portion which is inserted into the opening of the cap and passes through the concave portion of the cap, and wherein, when the connection portion of the socket passes through the concave portion of the cap and is rotated, the connection portion of the socket is coupled to the cap and is electrically connected to the connector of the light source.

18. The lighting device of claim 17, wherein the connector of the light source has a predetermined elasticity, wherein the connector of the light source has one end connected to the substrate and the other end protruding outward from the substrate, and wherein, when the connection portion of the socket passes through the concave portion of the cap and is rotated, the other end of the connector is directly connected to the connection portion of the socket.

19. A lighting device comprising:

a cover part which has an end and a cap disposed on the end, wherein the cap has an opening and a concave portion connected with the opening;

a light source which comprises a substrate disposed within the cover part, a light emitting device disposed on the substrate, and a connector disposed on the substrate; and a socket comprising a body disposed on the cap, a pin disposed on an outer surface of the body, and a connection portion disposed on an inner surface of the body, wherein the connection portion is inserted into the opening of the cap and passes through the concave portion of the cap, when the socket is rotated at a predetermined angle, the connection portion of the socket is electrically and mechanically connected to the connector of the light source, and is mechanically connected to the cap of the cover part.

20. The lighting device of claim 19, wherein the connector of the light source has a predetermined elasticity.

* * * * *